United States Patent [19]

Dorogy, Jr. et al.

[11] Patent Number: 5,023,034

[45] Date of Patent: Jun. 11, 1991

[54] WET SPINNING OF SOLID POLYAMIC ACID FIBERS

[75] Inventors: William E. Dorogy, Jr., Newport News; Anne K. St. Clair, Poquoson, both of Va.

[73] Assignee: The United States of America as represented by the Administrator of the National Aeronautics and Space Administration, Washington, D.C.

[21] Appl. No.: 543,926

[22] Filed: Jun. 26, 1990

Related U.S. Application Data

[63] Continuation-in-part of Ser. No. 410,572, Sep. 21, 1989, abandoned.

[51] Int. Cl.[5] ..... D01F 6/74

[52] U.S. Cl. ..... 264/184; 264/211.15; 264/211.16; 264/211.17; 264/234; 264/236; 264/345; 264/347

[58] Field of Search ..... 264/184, 211.16, 211.17, 264/234, 345, 211.15, 236, 347

[56] References Cited

U.S. PATENT DOCUMENTS 4,056,598 11/1977 Galasso et al. ..... 264/184

*Primary Examiner*—Hubert C. Lorin

*Attorney, Agent, or Firm*—George F. Helfrich

[57] ABSTRACT

The invention is a process for the production of solid aromatic polyamic acid and polyimide fibers from a wet gel or coagulation bath wet get using N,N-dimethylacetamide (DMAc) solutions of the polyamic acid derived from aromatic dianhydrides such as 3,3',4,4'-benzophenonetetracarboxylic dianhydride (BTDA) and aromatic diamines such as 4,4'-oxydianiline (4,4'-ODA). By utilizing the interrelationship between coagulation medium and concentration, resin inherent viscosity, resin % solids, filament diameter, and fiber void content, it is possible to make improved polyamic acid fibers. Solid polyimide fibers, obtained by the thermal cyclization of the polyamic acid precursor, have increased tensile properties compared to fibers containing macropores from the same resin system.

8 Claims, 1 Drawing Sheet

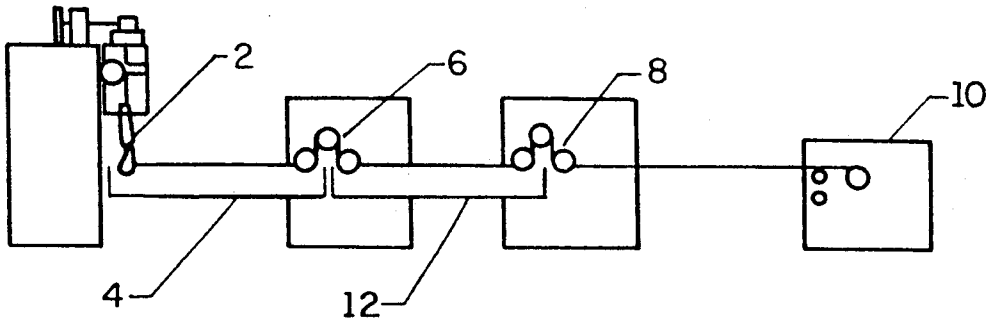
FIGURE 1
FIGURE 2
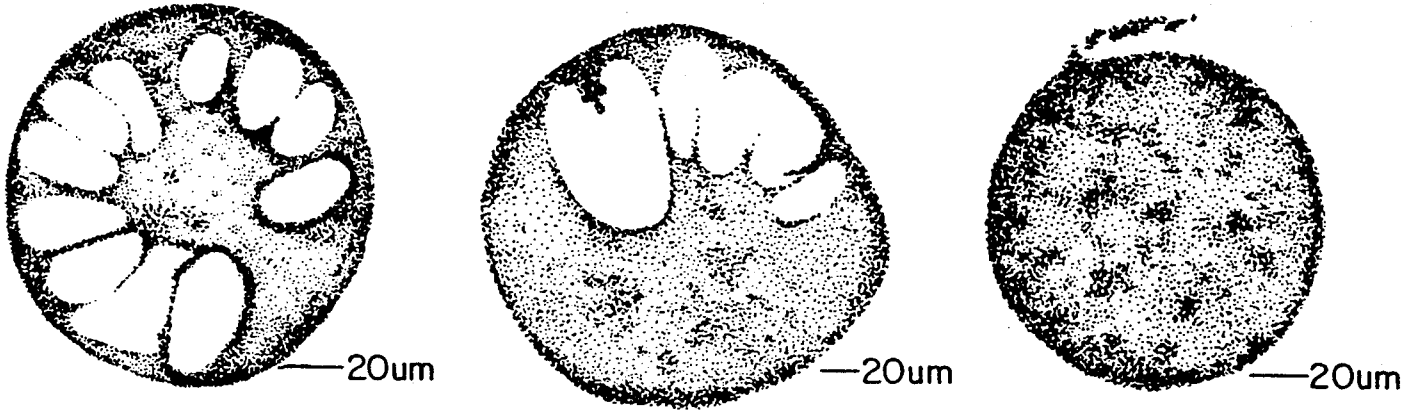
FIGURE 2A
FIGURE 2B
FIGURE 2C

WET SPINNING OF SOLID POLYAMIC ACID FIBERS

ORIGIN OF THE INVENTION

The invention described herein was made jointly in the performance of work under a NASA contract and is subject to the provisions of Section 305 of the National Aeronautics and Space Act of 1958, Public Law 85-568 (72 Stat. 435; 42 USC 2457).

CROSS REFERENCE

This application is a continuation in part of our application Ser. No. 07/410,572, filed Sept. 21, 1989, now abandoned.

BACKGROUND OF THE INVENTION

1. Field of the Invention

This invention relates to structural resins and in particular to the process of forming solid polyamic acid and polyimide fibers by wet spinning, whereby fibers with excellent chemical resistance, high thermal stability, and tensile properties in the range of standard textile fibers are produced.

2. Description of the Related Art

Linear aromatic polyimides are finding increased usage in industrial and aerospace applications due to their excellent chemical resistance and high temperature stability. They are mainly used in film form, as coatings and composite matrix resin. Various patents and articles have described the formation of aromatic polyamic acid and polyimide fibers, but little commercial development has resulted. Recently, Lenzig AG reported the production of a commercially available aromatic copolyimide fiber P84 using a special dry spinning and finishing process (Proc. 2nd Inter. Conf. Polyimides 1985, 253–271). The main advantages of P84 compared to other high performance fibers are reportedly its outstanding non-flammability, long term thermal stability, non-melting behavior, and excellent chemical resistance to acids and organic solvents. These properties are common to most aromatic polyimides. Suggested applications for this type of fiber are protective clothing, sealing materials, filtration in harsh chemical and/or high thermal environments, and various other textile uses where fire-resistant properties are required.

Production of aromatic polyamic acid fibers by the extrusion of a polyamic acid resin solution into a liquid coagulation medium was reported (U.S. Pat. No. 3,179,614) as early as 1965. The aromatic polyamic acid is generally formed in aprotic organic solvents such as N,N-dimethylformamide (DMF), N,N-dimethylacetamide (DMAc), dimethylsulfoxide (DMSO), and N-methylpyrrolidione (NMP) at concentrations of between 0.05 and 40% solids (w/w). Resin inherent viscosities were found to vary from 0.1 to 5.0 dl/g. Mono-, di-, or trihydric alcohols, or mixtures thereof, or aqueous solutions, or acetone solutions of said alcohols, aqueous solutions of aprotic organic solvents, and thiocyanate or sulfur salts in aqueous DMAc have been used as coagulation media. No disclosure has been found of the production of totally void free solid aromatic polyamic acid fibers that do not contain macropores or voids.

SUMMARY OF THE INVENTION

One object of the present invention is to provide a process for the production of solid aromatic polyamic acid fibers.

Another object of the present invention is to provide a process for the production of solid aromatic polyamic acid fibers from wet gel or coagulation bath wet gel.

Another object of the present invention is to provide a process for the production of solid aromatic polyamic acid fibers using DMAc solutions of the polyamic acid derived from 3,3',4,4'-benzophenonetetracarboxylic dianhydride (BTDA) and 4,4'-oxydianiline (4,4'-ODA).

Another object of the present invention is to provide a process for the production of solid polyamic acid fibers which utilizes the interrelationship between coagulation medium composition and concentration, resin inherent viscosity, resin % solids, filament diameter, and fiber void content.

Another object of the present invention is to provide a process for producing solid polyimide fibers.

Another object of the present invention is to produce polyamic acid and polyimide fibers that will be useful for both industrial and aerospace applications requiring fibers with excellent chemical resistance, high thermal stability, and tensile properties in the range of standard textile fiber, such as protective clothing, sealing materials, filtration in harsh chemical and/or high thermal environments, and various other textile uses where fire-resistant properties are important.

By the present invention, solid aromatic polyamic acid fibers have been produced using DMAc solutions of the polyamic acid derived from BTDA and 4,4'-ODA with either 70–75% aqueous ethylene glycol or 70–80% aqueous ethanol as the coagulation medium. Polyimide fibers, obtained by the thermal cyclization of the polyamic acid precursor, were found to exhibit enhanced tensile properties compared to fibers containing macropores from the same resin system. A chemical curing will also provide solid polyimide fibers. It is anticipated that these fibers will be useful for both industrial and aerospace applications requiring fibers with excellent chemical resistance, high thermal stability, and tensile properties in the range of standard textile fibers.

The success of the present invention is acquired by the use of the interrelationship between coagulation medium composition and concentration, resin inherent viscosity, resin % solids, filament diameter, and fiber void content to produce solid aromatic polyamic acid fibers. The general requirements for the production of solid coagulation bath fibers from a DMAc solution of the BTDA/4,4'-ODA polyamic acid are for the resin to have a minimum inherent viscosity of about 1.6 dl/g and at least approximately 15% solids. The coagulation bath should consist of either 70–75% aqueous ethylene glycol or 70–80% aqueous ethanol at temperatures near 20° C. Coagulation bath fiber diameters should be kept less than 50 microns.

Although other factors such as coagulation bath temperature, concentration and temperature of the wash bath, and wet gel drying conditions are known to effect the production of solid filaments in other fiber systems, these factors did not appear to significantly affect void formation in the fibers of the present invention.

BRIEF DESCRIPTION OF THE DRAWINGS

FIG. 1 is a schematic showing of commonly used Fiber Wet Spinning Equipment.

FIG. 2 shows examples of fibers with and without voids using SEM photos of fractured ends of coagulation bath fibers. FIG. 2A is a polyamic acid filament from a system where the aqueous coagulation medium was 60% ethanol and there was a resin inherent viscosity of 1.3 dl/g. FIG. 2B is a polyamic acid filament from a system where the aqueous coagulation medium was 70% ethanol and the resin inherent viscosity was 1.3 dl/g. FIG. 2C is a polyamic acid filament prepared according to the process of the present invention where the aqueous coagulation medium was 70% ethanol and the resin inherent viscosity was 1.6 dl/g.

DESCRIPTION OF THE PREFERRED EMBODIMENTS

Aromatic polyamic acid fibers were produced using the equipment shown in FIG. 1, purchased from an outside source. A polyamic acid resin was poured into stainless steel extrusion cylinder/piston assembly 2 and extruded through a spinnerette immersed in liquid coagulation bath 4. The solidifying filament was drawn through liquid coagulation bath 4 and onto cluster rolls 6. The filament then traveled through water wash bath 12, over second set of cluster rolls 8, and onto a pyrex or stainless steel spool on winder 10. Polyamic acid filaments collected at this point that have not been dried are termed "wet gel," versus those collected from the first set of cluster rolls termed "coagulation bath wet gel." Drying of the filaments was carried out either in a forced air or vacuum oven. After drying, the polyamic acid fibers were converted to polyimide fibers by further heating in a forced air oven.

Although this work concentrated on the spinning conditions required to produce solid filaments from the polyamic acid resin derived from BTDA and 4,4'-ODA, solid filaments may possibly be obtained from other polyamic acid resins by modifying certain of the spinning conditions to be discussed next. Coagulation medium composition and concentration, resin inherent viscosity, resin % solids, and filament diameter are all interrelated as to their effect on the production of solid coagulation bath wet gel. Washing and drying of the coagulation bath wet gel generally does not cause the formation of significant voids within the filament as long as care is taken to assure "good collapse" or consolidation of the wet gel structure during drying to fiber form. Therefore, this process concerns the production of solid coagulation bath fiber.

Fiber void content was determined by the visual inspection of at least eight fractured fiber ends using either an optical or scanning electron microscope (SEM) and reported as "% solid fibers." A value of "100" signifies that all the fibers examined were solid, whereas a value of "50" indicates only half of the fibers examined were solid.

Resin inherent viscosity, resin viscosity, and % solids were varied during the formation of the polyamic acid resin. The % solids are determined by the weight of the monomers and DMAc solvent used during the polymerization process. Resin inherent viscosity is determined by the polymerization reaction and can be influenced by the molar ratio of the monomers, purity of the monomers and solvent, percent solids, and reaction temperature, as well as time. It was measured at 0.5 percent solids (w/w) in DMAc at 35° C. It was generally found that the production of solid coagulation bath fibers required a minimum resin concentration of approximately 15% solids and a minimum inherent viscosity of about 1.6 dl/g (see Tables I and II). Spinning of resins with greater than 15% solids and inherent viscosities above 1.6 dl/g have not been attempted in this work because the resins are so viscous that extrusion would be difficult. However, if conditions could be modified to allow extrusion using concentrations above 15% solids and inherent viscosities above 1.6 dl/g, solid fibers could forseeably be produced. Resin viscosity was measured using a Brookfield viscometer at ambient temperature. Measurement of resin viscosities indicated that a high resin viscosity would not result in solid fibers unless the inherent viscosity and % solids were also at acceptable levels. However, if the resin viscosity was lower than 40 poise at 24° C. with 15% resin solids and the filament diameter was near 50 microns, the coagulation bath fibers always contained voids.

TABLE I

| 70% Aqueous Ethylene Glycol Coagulation Bath | | | |
|---|---|---|---|
| Resin Inherent Viscosity (dl/g) | Resin % Solids | Fiber Diameter (Microns) | % Solid Fibers |
| 1.1 | 20.0 | 41 | 0 |
| 1.3 | 20.0 | 84 | 80 |
| 1.2 | 15.0 | 54 | 0 |
| 1.3 | 14.5 | 50 | 11 |
| 1.6 | 14.5 | 64 | 95 |
| 1.6 | 14.5 | 45 | 100 |
| 1.6 | 14.5 | 31 | 100 |
| 1.9 | 15.0 | 63 | 100 |
| 2.1-1.6 | 9.7 | 47 | 75 |

TABLE II

| Aqueous Ethanol Coagulation Bath | | | | |
|---|---|---|---|---|
| % Aqueous EtOH | Resin Inherent Viscosity (dl/g) | Resin % Solids | Fiber Diameter (Microns) | % Solids Fibers |
| 80 | 1.3 | 14.5 | 34 | 100 |
| 80 | 1.6 | 14.5 | 55 | 83 |
| 80 | 1.6 | 14.5 | 35 | 100 |
| 70 | 1.3 | 14.5 | 28 | 73 |
| 70 | 1.6 | 14.5 | 54 | 100 |
| 70 | 1.6 | 14.5 | 33 | 100 |
| 70 | 1.1 | 20.0 | 37 | 60 |
| 60 | 1.3 | 14.5 | 48 | 0 |

Ethylene glycol (EtG), ethanol (EtOH), and aqueous solutions of either EtG or EtOH were investigated as coagulation media to produce solid core fiber. Solid coagulation bath fibers were obtained using either 70-75% aqueous EtG or 70-100% aqueous EtOH. A value of 70% aqueous EtOH signifies 70 grams of EtOH mixed with 30 grams of water. However, concentrations greater than 80% aqueous EtOH and 75% aqueous EtG tended to cause the filament in the coagulation bath to spiral as it exited the spinnerette and then sway back and forth in the bath until it contacted the first set of cluster rolls. This is a very fragile and unstable state at which to produce filaments; it is termed "poor spinnability," and conditions that caused this state were generally avoided.

Filament diameter is also important for the production of the solid coagulation bath fibers of the present invention. It is determined by the resin % solids, rate of resin extrusion, size and number of holes in the spinnerette, and the difference in velocity between the resin stream as it exits the spinnerette and the roll surface of the first set of cluster rolls, termed "jet stretch." The rate of resin extrusion depends on the volume of the extrusion cylinder/piston assembly and the velocity of the piston as it moves into the cylinder. Spinnerettes used in this work all had a single hole of either 50 or 100 microns in diameter. Filament diameters are reported as the average of at least six measurements from SEM photos of fractured fibers ends. The production of solid coagulation bath fibers from resins with inherent viscosities of less than 1.6 dl/g could be achieved if conditions were chosen such that diameters much less than 50 microns were obtained. Whereas, solid coagulation bath fibers having diameters in excess of 50 microns could be obtained from resins with inherent viscosities in excess of 1.6 dl/g (see Tables I and II).

Although other factors such as coagulation bath temperature, concentration and temperature of the wash bath, and wet gel drying conditions are known in other fiber systems to effect the production of solid filaments, these factors did not appear to significantly effect void formation in the fibers of the present invention. The coagulation bath temperature was varied from 0° to 30° C. while the pure water wash bath was held at 30°-31° C. Temperatures in excess of 31° C. were not investigated in order to minimize hydrolysis of the polyamic acid. Drying for between 15-18 hours was carried out at 80°-85° C. also to minimize the possibility of hydrolysis during collapse and removal of water/DMAc/EtG or EtOH from the liquid swollen wet gel. Both forced air or vacuum (at 30 inches of Hg) drying did not appear to cause void formation (see Table III).

TABLE III

| Coagulation Bath Composition | Drying of Coagulation Bath Wet Gel: 80° C., Air Oven 15-18 hours | 80°, Vac Oven 15-18 hours | Diameter (Microns) | Fiber Fiber % Solids |
|---|---|---|---|---|
| 70% Aqueous ethylene glycol | yes | | 35 | 100 |
| 70% Aqueous ethylene glycol | | yes | 35 | 100 |
| 80% Aqueous ethanol | yes | | 36 | 100 |
| 80% Aqueous ethanol | | yes | 35 | 100 |

It must therefore be concluded that the success of the present invention is attained by the use of the interrelationship between coagulation medium composition and concentration, resin inherent viscosity, resin % solids, filament diameter, and fiber void content to produce solid aromatic polyamic acid fibers. The general requirements for the production of solid coagulation bath fibers from a DMAc solution of the BTDA/4,4'-ODA polyamic acid are for the resin to have a minimum inherent viscosity of 1.6 dl/g and at least 15% solids. The coagulation bath should consist of either 70-75% aqueous EtG or 70-80% aqueous EtOH at temperatures near 20° C. Coagulation bath fiber diameters should be kept less than 50 microns.

Although the polyamic acid fibers were thermally imidized, polyimide fibers could also be created by passing the polyamic acid fibers through a solution containing pyridine and acetic anhydride to chemically cyclize the imide ring.

EXAMPLES

Example 1

This Invention

To a two liter resin kettle was added 55.69 g of 4,4'-oxydianiline (4,4'-ODA) and most of 854.70 g of dry N,N-dimethylacetamide (DMAc). The kettle was then purged with dry nitrogen, and stirring was begun and continued until all the 4,4'-ODA dissolved in the DMAc. A total of 89.61 g of 3,3',4,4'-benzophenonetetracarboxylic dianhydride (BTDA) (vacuum dried for 20 hours at 150° C.) was added at once, with any residual BTDA being washed into the reaction solution using the remaining DMAc, the reaction vessel was again purged with dry nitrogen, and stirring was resumed. The reaction was allowed to continue under a constant flow of dry nitrogen for between four to six hours at ambient temperature. The inherent viscosity of the resulting polymer was determined to be 1.6 dl/g at 35° C., with a corresponding Brookfield or resin viscosity of 572 poise at 24.7° C. The resulting polyamic acid solution (14.5% solids) was refrigerated until used for fiber spinning.

The resin was poured into the extrusion cylinder/piston assembly and allowed to stand at 35° C. until all the entrapped air migrated out of the solution. The remaining parts of the extrusion assembly and spinnerette (one hole with 100 micron diameter) were attached and resin extruded at a rate of 0.098 ml/min for several minutes to remove any residual air in the system. The spinnerette was then immersed in a 70.7% aqueous ethylene glycol (EtG) coagulation bath which was at 20.5° C. The solidifying filament was grasped using tweezers, drawn through the bath, and onto the first set of cluster rolls, operating at a surface speed of 60-62 fpm. Coagulation bath wet gel was collected by wrapping the filament around the last roll of this cluster, which was partially immersed in a pure water wash bath at 30.4° C. The wet gel was carefully removed from this cluster roll and then dried at 80°-85° C. in a vacuum oven for 16-18 hours. Examination of the fractured fiber ends using either an optical or SEM microscope revealed that 100% of these fibers were solid with an average filament diameter of 42 microns.

Example 2

This Invention

Production of polyamic acid filaments was carried out in a manner similar to Example 1 with the following experimental conditions:

| | |
|---|---|
| Resin inherent viscosity | 1.6 dl/g; |
| Resin viscosity | 572 poise at 24.7° C.; |
| Resin % solids | 14.5; |
| Resin extrusion rate | 0.098 ml/min; |
| Resin temp. | 35° C.; |
| Coag. bath % aq. conc. | 70% EtOH; |
| Coag. bath temperature | 20.1° C.; |
| First cluster roll speed | 68-70 fpm; and |
| Wash bath temp. | 30.3° C. |

Coagulation bath fibers produced using the above conditions were found to be 100% solid and have a diameter of 33 microns (see FIG. 2C).

Example 3

This Invention

Production of polyamic acid filaments was carried out in a manner similar to Example 1 with the following experimental conditions:

| | |
|---|---|
| Resin inherent viscosity | 1.6 dl/g; |
| Resin viscosity | 572 poise at 24.7° C.; |
| Resin % solids | 14.5; |
| Resin extrusion rate | 0.098 ml/min; |
| Resin temp. | 35° C.; |
| Coag. bath % aq. conc. | 80% EtOH; |
| Coag. bath temperature | 19.0° C.; |
| First cluster roll speed | 67-69 fpm; and |
| Wash bath temeperature | 30.4° C. |

Coagulation bath fibers produced using the above conditions were found to be 100% solid and have a diameter of 35 microns.

Example 4

This Invention

Production of polyamic acid filaments was carried out in a manner similar to Example 3 with the additional experimental conditions:

| | |
|---|---|
| Second cluster roll speed | 72-74 fpm; and |
| Winder spool speed | 75-76 fpm. |

Wet gel was now collected by wrapping the filament around a removable pyrex spool on the winder. The spool of filaments was vacuum dried at 80°-85° C. for 16-18 hours. Thermal imidization of these polyamic acid fibers was carried out by heating the spool of fibers in a forced air oven for one hour each at 100°, 200°, and 300° C. These polyimide fibers were found to be 100% solid and have a diameter of 25 microns. Their single filament tensile properties were measured as follows (see Table IV):

| | |
|---|---|
| Tenacity | $2.8 \times 10^4$ psi; |
| Initial modulus | $52.7 \times 10^4$ psi; |
| Yield point | $1.8 \times 10^4$ psi; and |
| % Elongation | 65. |

TABLE IV

Polyimide Fiber Tensile Properties

| Example Number | 10 | 11 | 5 | 4 | 6 |
|---|---|---|---|---|---|
| Aqueous Coagulation Bath Concentration | 20% DMAc | 60% EtOH | 70% EtOH | 80% EtOH | 71% EtG |
| % Solid Fibers | 0 | 0 | 100 | 100 | 100 |
| Filament Diameter (microns) | 36 | 26 | 25 | 25 | 25 |
| Tenacity (psi $\times 10^4$) | 0.67 | 1.5 | 3.0 | 2.8 | 2.6 |
| Initial Modulus (psi $\times 10^4$) | 20.5 | 46.1 | 51.0 | 52.7 | 51.3 |
| Yield Point (psi $\times 10^4$) | none | none | 1.9 | 1.8 | 1.8 |
| % Elongation | 12 | 15 | 66 | 65 | 68 |

Example 5

This Invention

Production of polyamic acid filaments was carried out in a manner similar to Example 2 with the additional experimental conditions:

| | |
|---|---|
| Second cluster roll speed | 71-73 fpm; and |
| Winder spool speed | 75-76 fpm. |

Filaments were collected, dried, and thermally imidized as in Example 4. These polyimide fibers were found to be 100% solid and have a diameter of 25 microns. The single filament tensile properties were measured as follows (see Table IV):

| | |
|---|---|
| Tenacity | $3.0 \times 10^4$ psi; |
| Initial Modulus | $51.0 \times 10^4$ psi; |
| Yield Point | $1.9 \times 10^4$ psi; and |
| % Elongation | 66. |

Example 6

This Invention

Production of polyamic acid filaments was carried out in a manner similar to Example 1 with the additional experimental conditions:

| | |
|---|---|
| Second cluster roll speed | 66-68 fpm; and |
| Winder spool speed | 72-73 fpm. |

Filaments were collected, dried, and thermally imidized as in Example 4. These polyimide fibers were found to be 100% solid and have a diameter of 25 microns. Their single filament tensile properties were measured as follows (see Table IV):

| | |
|---|---|
| Tenacity | $2.6 \times 10^4$ psi; |
| Initial Modulus | $51.3 \times 10^4$ psi; |
| Yield Point | $1.8 \times 10^4$ psi; and |
| % Elongation | 68. |

The following examples are not of this invention, but are included for comparative purposes only:

Example 7

Production of polyamic acid filaments was carried out in a manner similar to Example 1 with the following experimental conditions:

| | |
|---|---|
| Resin inherent viscosity | 1.6 dl/g; |
| Resin viscosity | 428 poise at 24.0° C.; |
| Resin % solids | 15.0; |
| Resin extrusion rate | 0.098 ml/min; |
| Resin temp. | 35° C.; |
| Coag. bath % aq. conc. | 72.3% EtG; |
| Coag. bath temperature | 20.1° C.; |
| First cluster roll speed | 24-26 fpm; and |
| Wash bath temperature | 30.6° C. |

Coagulation bath fibers produced using the above conditions were found to be 33% solid and have a diameter of 76 microns.

Example 8

Production of polyamic acid filaments was carried out in a manner similar to Example 1 with the following experimental conditions:

| | |
|---|---|
| Resin inherent viscosity | 1.3 dl/g; |
| Resin viscosity | 43 poise at 24.0° C.; |
| Resin % solids | 14.5; |
| Resin extrusion rate | 0.098 ml/min; |
| Resin temp. | 28° C.; |
| Coag. bath % aq. conc. | 70% EtOH; |
| Coag. bath temperature | 20.4° C.; |
| First cluster roll speed | 67–68 fpm; and |
| Wash bath temperature | 30.6° C. |

Coagulation bath fibers produced using the above conditions were found to be 73% solid and have a diameter of 28 microns (see FIG. 2B).

Example 9

Production of polyamic acid filaments was carried out in a manner similar to Example 1 with the following experimental conditions:

| | |
|---|---|
| Resin inherent viscosity | 1.6 dl/g; |
| Resin inherent viscosity | 572 poise at 24.7° C.; |
| Resin % solids | 14.5; |
| Resin extrusion rate | 0.098 ml/min; |
| Resin temp. | 35° C.; |
| Coag. bath % aq. conc. | 19.8% DMAc; |
| Coag. bath temperature | 19.9° C.; |
| First cluster roll speed | 60–63 fpm; and |
| Wash bath temperature | 30.4° C. |

Coagulation bath fibers produced using the above conditions were found to be 0% solid and have a diameter of 57 microns.

Example 10

Production of polyamic acid filaments was carried out in a manner similar to Example 9 with the additional experimental conditions:

| | |
|---|---|
| Second cluster roll speed | 70–73 fpm; and |
| Winder spool speed | 75–76 fpm. |

Filaments were collected, dried, and thermally imidized as in Example 4. These polyimide fibers were found to be 0% solid and have a diameter of 36 microns. Their single filament tensile properties were measured as follows (see Table IV):

| | |
|---|---|
| Tenacity | $0.67 \times 10^4$ psi; |
| Initial Modulus | $20.5 \times 10^4$ psi; |
| Yield Point | none; and |
| Elongation | 12. |

Example 11

Production of polyamic acid filaments was carried out in a manner similar to Example 1 with the following experimental conditions:

| | |
|---|---|
| Resin inherent viscosity | 1.3 dl/g; |
| Resin viscosity | 43 poise at 24.0° C.; |
| Resin % solids | 14.5; |

-continued

| | |
|---|---|
| Resin extrusion rate | 0.098 ml/min; |
| Resin temp. | 23° C.; |
| Coag. bath % aq. conc. | 60% EtOH; |
| Coag. bath temperature | 20.4° C; |
| First cluster roll speed | 67–68 fpm; |
| Wash bath temperature | 30.4° C.; |
| 2nd cluster roll speed | 74–75 fpm; and |
| Winder spool speed | 74–75 fpm. |

Samples of coagulation bath fiber were collected as in Example 1 and found to be 0% solid and have a diameter of 48 microns (see FIG. 2A). Wet gel filaments were collected, dried and thermally imidized as in Example 4. These polyimide fibers were found to be 0% solid and have a diameter of 26 microns. Their single filament tensile properties were measured as follows (see Table IV):

| | |
|---|---|
| Tenacity | $1.5 \times 10^4$ psi; |
| Initial Modulus | $46.1 \times 10^4$ psi; |
| Yield Point | none; and |
| % Elongation | 15. |

The foregoing specific examples are merely to illustrate the present invention in exemplary fashion and are not intended, or to be interpreted, as exhaustive.

The specific polyamic acid resin, solvent, coagulation medium compositions and concentrations, and other process conditions in the figures and tables and specific examples herein are also exemplary only and are intended merely to illustrate the process for the production of solid polyamic acid fibers. It is to be understood that the use of these process conditions, including the various coagulation medium composition and concentrations, to achieve solid polyamic acid fibers from other aromatic polyamic acid polymers is considered within the scope of the present invention.

Thus, various modification and variations of the present invention will be apparent to those skilled in the art in light of the above techniques. It is therefore to be understood that, within the scope of the appended claims, the invention may be practiced otherwise than as specifically claimed.

What is claimed as new and desired to be secured by Letters Patent of the United States is:

1. A process for preparing solid aromatic polyamic acid fibers comprising the steps of:

(a) reacting of an aromatic dianhydride with an aromatic diamine in an aprotic organic solvent so that the resulting resin solution has a solid content of at least about 15% (w/w) and a resin inherent viscosity of at least about 1.6 dl/g at approximately 35° C.;

(b) extruding the resin solution into a coagulation bath selected from the group consisting of:

an alcohol and an aqueous solution of an alcohol;

so that the diameters of the resulting fibers are approximately 50 microns or less when the resin inherent viscosity of the resin solution is approximately 1.6 dl/g.

2. The process according to claim 1 additionally comprising curing the resulting solid polyamic acid fibers to prepare solid aromatic polyimide fibers.

3. The process according to claim 2, wherein the curing is a thermal curing.

4. The process according to claim 2, wherein the curing is a chemical curing.

5. A process for preparing solid aromatic polyamic acid fibers comprising the steps of:

(a) reacting 4,4'-oxydianiline with 3,3',4,4'-benzophenonetetracarboxylic dianhydride in N,N-dimethylacetamide so that the resulting resin solution has a solid content of at least 15% (w/w) and a resin inherent viscosity of at least 1.6 dl/g at approximately 35° C.;

(b) extruding the resin solution into a coagulation bath of 70–75% aqueous ethylene glycol or 70–80% aqueous ethanol so that the diameters of the resulting fibers are approximately 50 microns or less when the resin inherent viscosity of the resin solution is approximately 1.6 dl/g.

6. The process according to claim 5 additionally comprising curing the resulting polyamic acid fibers to prepare solid aromatic polyimide fibers.

7. The process according to claim 6, wherein the curing is a thermal curing.

8. The process according to claim 6, wherein the curing is a chemical curing.

* * * * *